US005079076A

United States Patent [19]

Lal

[11] Patent Number: 5,079,076

[45] Date of Patent: Jan. 7, 1992

[54] COMPOSITION AND POLYMER FABRICS TREATED WITH THE SAME

[75] Inventor: Kasturi Lal, Willoughby, Ohio

[73] Assignee: The Lubrizol Corporation, Wickliffe, Ohio

[21] Appl. No.: 494,064

[22] Filed: Mar. 15, 1990

[51] Int. Cl.[5] ..... D03D 15/00; D04B 1/00; D04H 11/06; D06M 13/322

[52] U.S. Cl. ..... 428/224; 252/8.6; 252/8.8; 252/8.9; 252/8.75; 8/115.6; 8/115.51; 8/194; 562/555; 562/564; 562/567; 564/95

[58] Field of Search ..... 428/224; 8/115.6, 115.51, 8/194; 162/158, 179; 427/384, 394, 395; 252/8.6, 8.9, 8.75; 562/555, 564, 567; 260/400, 401; 564/95

[56] References Cited

U.S. PATENT DOCUMENTS

| | | | |
|---|---|---|---|
| 4,520,155 | 5/1985 | Higgins | 524/166 |
| 4,738,676 | 4/1988 | Osborn, III | 604/385 |
| 4,753,834 | 6/1988 | Braun et al. | 428/338 |

OTHER PUBLICATIONS

AMPS ® Monomer Brochure ®The Lubrizol Corporation 1987, 387360–43R).

*Primary Examiner*—Jenna Davis
*Assistant Examiner*—Kathryne E. Shelborne
*Attorney, Agent, or Firm*—Forrest L. Collins; Frederick D. Hunter; Joseph P. Fischer

[57] ABSTRACT

This invention relates to a composition prepared by reacting, in the presence of a redox initiator and a mineral acid, (a) at least one hydroxyl-containing imide, amide or mixtures thereof of a hydrocarbyl substituted carboxylic acid or anhydride having a hydrocarbyl group containing from about 8 to about 150 carbon atoms and a hydroxy amine; with (b) at least one sulfo compound represented by the following formula:

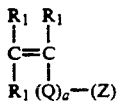

wherein each $R_1$ is independently hydrogen or a hydrocarbyl group;

a is zero or one;

Q is a hydrocarbylene group or —C(X)N($R_2$)Q'—;

$R_2$ is hydrogen or a hydrocarbyl group;

X is sulfur or oxygen;

Q' is a hydrocarbylene group; and

Z is —S(O)OH, or —S(O)$_2$OH or an ester, a metal salt or an ammonium salt of the sulfo compound.

The invention also relates to polymer fabrics treated with the compositions of the present invention. The treated polymer fabrics have improved wicking/wetting characteristics. Further, the treated polymer fabrics maintain these characteristics upon repeated exposure to fluids.

31 Claims, No Drawings

COMPOSITION AND POLYMER FABRICS TREATED WITH THE SAME

FIELD OF THE INVENTION

This invention relates to compositions useful as wetting agents and polymer fabrics treated with the same.

BACKGROUND OF THE INVENTION

Polymer fabrics are extensively used in a wide variety of products, ranging from disposable towel sheets to sanitary napkins and from disposable diapers to surgical sponges. All these applications involve the absorption of water or aqueous liquids (urine, blood, lymph, spills of coffee, tea, milk, etc.). The fabrics must have good wicking properties, i.e., water must be readily taken up and spread.

Polymer fabrics are generally hydrophobic. It is desirable to improve the wicking/wetting ability of the polymer fabrics. Often wetting agents are used to improve the ability of the polymer fabric to pass water and bodily fluids through the polymer fabric and into an absorbant layer. Further, it is desirable that the polymer fabric maintain its wicking/wetting characteristics after repeated exposure to water or aqueous liquids.

SUMMARY OF THE INVENTION

This invention relates to a composition prepared, in the presence of a redox initiator and a mineral acid, by reacting (a) at least one hydroxyl-containing imide, amide or mixtures thereof of a hydrocarbyl substituted carboxylic acid or anhydride having a hydrocarbyl group containing from about 8 to about 150 carbon atoms and a hydroxy amine; with (b) at least one sulfo compound represented by the following formula:

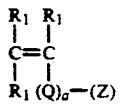

wherein each $R_1$ is independently hydrogen or a hydrocarbyl group;

a is zero or one;

Q is a hydrocarbylene group or —C(X)N($R_2$)Q'—;

$R_2$ is hydrogen or a hydrocarbyl group;

X is sulfur or oxygen;

Q' is a hydrocarbylene group; and

Z is —S(O)OH, or —S(O)$_2$OH or an ester, a metal salt, or an ammonium salt of the sulfo compound.

The invention also relates to polymer fabrics treated with the compositions of the present invention. The treated polymer fabrics have improved wicking/wetting characteristics. Further, the treated polymer fabrics maintain these characteristics upon repeated exposure to aqueous fluids.

DESCRIPTION OF THE PREFERRED EMBODIMENTS

The carboxylic acids or anhydrides which are useful in making the compositions of the present invention are hydrocarbyl substituted mono- or polycarboxylic acids or anhydrides.

Preferably the hydrocarbyl group has from about 8 to about 150 carbon atoms, more preferably about 8 to about 100, more preferably from about 8 to about 50, more preferably from about 8 to about 30, more preferably about 8 to about 24, more preferably about 10 to about 18 carbon atoms. Preferably, the hydrocarbyl group is an alkyl group, an alkenyl group, a polyalkene group or mixtures thereof, more preferably an alkyl or alkenyl group. When the hydrocarbyl group is a polyalkene the polyalkene group is characterized as having a number average molecular weight (Mn) of about 400 to about 2000, more preferably 800 to about 1500, more preferably 900 to about 1100.

In one embodiment, the carboxylic acid or anhydride has an octyl, decyl, dodecyl, tridecyl, tetradecyl, hexadecyl, octadecyl, dodecenyl, tetradecenyl, hexadecenyl, octadecenyl, oleyl or soya group.

In another embodiment, the carboxylic acid or anhydride has an alkyl or alkenyl group having from about 8 to about 30 carbon atoms. Preferably the alkyl or alkenyl group is derived from monoolefins having from about 2 to about 30 carbon atoms or oligomers thereof. The oligomers are generally prepared from olefins having less than 7 carbon atoms. Specific examples of olefins include ethylene, propylene or butylene, more preferably propylene. A preferred oligomer has 12 carbon atoms and is a propylene tetramer group. The alkyl or alkenyl group may be derived from mixtures of monoolefins.

In another embodiment, the carboxylic acids or anhydrides have a polyalkene group which is a homopolymer or an interpolymer of polymerizable olefin monomers of 2 to about 16 carbon atoms, preferably 2 to about 6, more preferably 3 or 4. The interpolymers are those in which 2 or more olefin monomers are interpolymerized according to well known conventional procedures to form polyalkenes. The monoolefins are preferably ethylene, propylene, butylene, or octylene with butylene preferred. A preferred polyalkene substituent is a polybutenyl group.

The polyalkene substituted carboxylic acids may be used together with the fatty alkyl or alkenyl substituted carboxylic acids. The fatty groups are those having from about 8 to about 30 carbon atoms. It is preferred that the polyalkene substituted carboxylic acids and the fatty substituted carboxylic acids are used in mixtures of a weight ratio of from about (0–1.5:1), more preferably about (0.5–1:1), more preferably about (1:1).

Preferably the carboxylic acids or anhydrides are polycarboxylic acids or anhydrides.

The polycarboxylic acids are carboxylic acids or anhydrides having from 2 to about 4 carbonyl groups. The polycarboxylic acids of the present invention are preferably dimer acids, trimer acids or substituted succinic acids or anhydrides.

The dimer and trimer acids are the products resulting from the dimerization and trimerization of unsaturated fatty acids. Preferably the dimer acids are carboxylic acid products of the dimerization of $C_8$ to $C_{26}$ monomeric unsaturated fatty acids such as described in U.S. Pat. Nos. 2,482,760, 2,482,761, 2,731,481, 2,793,219, 2,964,545, 2,978,468, 3,157,681, and 3,256,304, the entire disclosures of which are incorporated herein by reference. Examples of the dimerized $C_8$ to $C_{26}$ monomeric unsaturated fatty acids include but are not limited to such products as Empol® 1014 Dimer Acid and Empol® 1016 Dimer Acid each available from Emery Industries, Inc.

In another embodiment, the polycarboxylic acids are diacids which are the carboxylic acid products of the Diels-Alder type reaction of an unsaturated fatty acid with alpha,beta-ethylenically unsaturated carboxy acid (e.g., acrylic, methacrylic, maleic or fumaric acids) such as are taught in U.S. Pat. No. 2,444,328, the disclosure of which is incorporated herein by reference, and the Diels-Alder adduct of a three to four carbon atom alpha,beta-ethylenically unsaturated alkyl monocarboxylic or dicarboxylic acid (e.g., acrylic and fumaric acids respectively) and pimeric or abietic acids. Examples of the carboxylic acid product of a Diels-Alder type reaction include the commercially available Westvaco® Diacid 1525 and Westvaco® Diacid 1550, both being available from the Westvaco Corporation.

Preferably the polycarboxylic acid or anhydride is a succinic acid or anhydride.

The above carboxylic acids or anhydrides, including succinic acids and anhydrides as well as the above polyalkene groups are described in U.S. Pat. No. 4,234,435, issued to Meinhardt et al. This patent is incorporated by reference for its disclosure of carboxylic acids or anhydrides, sometimes referred to as carboxylic acylating agents, polyalkene groups and methods for making the same.

The above carboxylic acids or anhydrides are reacted with hydroxyamines, also referred to as aminoalcohols or alkanolamines, to form hydroxyl-containing amides, imides or mixtures thereof. The hydroxyamines, both mono- and polyamines, are primary or secondary amines.

The hydroxyamines may be represented by one of the formulae:

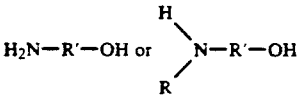

wherein each R is independently a hydrocarbyl group of one to about 18, preferably one to about eight or hydroxyhydrocarbyl group of two to about 18, preferably two to about eight carbon atoms and R′ is a divalent hydrocarbyl group of about two to about 18 carbon atoms, preferably 2 to about 6. The group —R′—OH in such formulae represents the hydroxyhydrocarbyl group. R′ can be an acyclic, alicyclic or aromatic group. Typically, R′ is an acyclic straight or branched alkylene group such as an ethylene, 1,2-propylene, 1,2-butylene, or 1,2-octadecylene group. Typically, however, each R is a methyl, ethyl, propyl, butyl, pentyl or hexyl group.

Examples of these hydroxyamines include monoethanol amine, diethanol amine, ethylethanol amine, di-(3-hydroxypropyl)-amine, 3-hydroxybutyl-amine, 4-hydroxybutyl-amine, di-(2-hydroxypropyl)-amine, N-(hydroxypropyl)propylamine, N-(2-hydroxyethyl)-cyclohexylamine, 3-hydroxycyclopentylamine, para-hydroxyaniline, N-hydroxyethyl piperazine, and the like.

Preferably the hydroxyamines are the hydroxysubstituted primary amines described in U.S. Pat. No. 3,576,743 by the general formula $$R_a—NH_2$$

where $R_a$ is a monovalent organic radical containing at least one alcoholic hydroxy group, according to this patent, the total number of carbon atoms in $R_a$ will not exceed about 20. Hydroxy-substituted aliphatic primary amines containing a total of up to about 10 carbon atoms are particularly useful. The alkanol primary amines correspond to $R_a—NH_2$ wherein $R_a$ is a mono- or polyhydroxy-substituted alkyl group. Specific examples of the hydroxy-substituted primary amines include 2-amino-1-butanol, 2-amino-2-methyl-1-propanol, p-(beta-hydroxyethyl)-aniline, 2-amino-1-propanol, 1-amino-2-propanol, 3-amino-1-propanol, 2-amino-2-methyl-1,3-propanediol, 2-amino-2-ethyl-1,3-propanediol, N-(beta-hydroxypropyl)-N′-(beta-aminoethyl)-piperazine, tris(hydroxymethyl)amino methane (also known as trismethylolamino methane), 2-amino-1-butanol, ethanolamine, beta-(beta- hydroxy ethoxy)-ethyl amine. For further description of the hydroxy-substituted primary amines contemplated as being useful in the present invention, U.S. Pat. No. 3,576,743 is incorporated herein by reference for its disclosure of such amines.

The hydroxyamines can also be an ether N-(hydroxyhydrocarbyl)amine. These are hydroxypoly(hydrocarbyloxy) analogs of the above-described hydroxyamines (these analogs also include hydroxyl-substituted oxyalkylene analogs). Such N-(hydroxyhydrocarbyl) amines can be conveniently prepared by reaction of epoxides with afore-described amines and can be represented by the formulae:

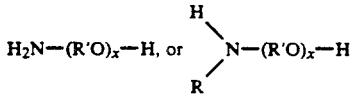

wherein x is a number from about 2 to about 15 and R and R′ are as described above. R may also be a hydroxypoly(hydrocarbyloxy) group.

Polyamine analogs of these hydroxy amines, particularly alkoxylated alkylene polyamines (e.g., N,N-(diethanol)-ethylene diamine) can also be used in accordance with the present invention. Such polyamines can be made by reacting alkylene amines (e.g., ethylenediamine) with one or more alkylene oxides (e.g., ethylene oxide, propylene oxide or octadecene oxide) of two to about 20 carbons. Similar alkylene oxide-alkanol amine reaction products can also be used such as the products made by reacting the afore-described primary, secondary or tertiary alkanol amines with ethylene, propylene or higher epoxides in a (1:1) or (1:2) molar ratio. Reactant ratios and temperatures for carrying out such reactions are known to those skilled in the art.

Specific examples of alkoxylated alkylene polyamines include N-(2-hydroxyethyl)ethylene diamine, N,N-bis(2-hydroxyethyl)-ethylene diamine, mono(hydroxypropyl)-substituted diethylene triamine, di(hydroxypropyl)-substituted tetraethylene pentamine, N-(3-hydroxybutyl)-tetramethylene diamine, etc. Higher homologs obtained by condensation of the above-illustrated hydroxy alkylene polyamines through amino radicals or through hydroxy radicals are likewise useful. Condensation through amino radicals results in a higher amine accompanied by removal of ammonia while condensation through the hydroxy radicals results in products containing ether linkages accompanied by removal of water. Mixtures of two or more of any of the afore described mono- or polyamines are also useful.

The above hydroxyamines are reacted with the carboxylic acids or anhydrides at a temperature of from about 50° C. up to the decomposition temperature of the reactants or reaction mixture, preferably between about 50° C. and about 250° C., more preferably about 75° C. and about 200° C. The hydroxyamines are reacted with the carboxylic acids or anhydrides at an equivalent ratio of about (0.5–1:1).

The following examples relate to hydroxy imides, amides or mixtures thereof useful in the present invention. Unless otherwise indicated, the temperature is degrees Celsius and parts are parts by weight.

EXAMPLE 1

A vessel, equipped with a mechanical stirrer, a thermometer, a water trap and a condenser, is charged with 266 parts (1 mole) of a tetrapropylene succinic anhydride, 75 parts (1 mole) of 1-amino-2-propanol and 250 parts of toluene. The reaction is heated to 105° to 110° C. and held for 7 hours, while 27 milliliters of water is collected. The reaction is vacuum-stripped at 110° C. and 15–25 millimeters of mercury. The product is a dark orange viscous fluid liquid with 4.28% nitrogen (theory 4.33%) and 7.38% hydroxyl (theory 5.26%).

EXAMPLE 2

A vessel, equipped as in Example 1, is charged with 561 parts (0.5 mole) of a polybutenyl succinic anhydride having a number average molecular weight of about 950, and 500 parts of xylene. The mixture is heated to 140° C. where 38 parts (0.5 mole) of the hydroxyamine of Example 1 is added over 1¼ hours. The temperature is maintained at 140° C. to 150° C. for 4½ hours, while 9 milliliters of water is collected. The reaction is vacuum-stripped to 155° C. and 15–25 millimeters of mercury. The residue has 1.18% nitrogen (theoretical 1.18%).

The hydroxyamine and carboxylic acid or anhydride react to form a hydroxyl-containing amide, imide or mixtures thereof, preferably an imide. The hydroxyl-containing amide, imide or mixture thereof is then further reacted with a sulfo compound of the general formula:

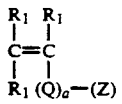

wherein each $R_1$ is independently hydrogen or a hydrocarbyl group; a is zero or one, preferably one; Q is a hydrocarbylene group or —C(X)N($R_2$)Q'—; $R_2$ is hydrogen or a hydrocarbyl group; X is sulfur or oxygen, preferably oxygen; Q' is a hydrocarbylene group; and Z is —S(O)OH or —S(O)$_2$OH, preferably —S(O)$_2$OH.

Each $R_1$ and $R_2$ is independently a hydrogen or an alkyl group having from 1 to 12 carbon atoms, preferably from 1 to about 6, more preferably 1 to about 4. Preferably, each $R_1$ and $R_2$ is independently hydrogen, or a methyl, ethyl, propyl or butyl group.

Preferably, each Q and Q' is independently selected from the group consisting of alkylene, arylene, alkylarylene, arylalkylene, more preferably alkylene. Q and Q' contain from 1 to about 24 carbon atoms, preferably 1 to about 18, more preferably 1 to 12, except where Q or Q' are arylene, alkylarylene or arylalkylene, where Q and Q' independently contain from 6 to about 24 carbon atoms, more preferably 6 to about 18, more preferably 6 to about 12. Q is preferably alkylene or —C(X)NR$_2$Q'—, with —C(X)NR$_2$Q'— being more preferred.

Examples of Q and Q' include, but are not limited to, methylene, ethylene, propylene, butylene, octylene, decylene, tolylene, naphthylene, cyclohexylene, cyclopentylene, dimethylethylene, diethylethylene, butylpropylethylene and the like, preferably dimethylethylene.

Useful sulfo compounds are sulfonic acid containing compounds. Sulfonic acid containing compounds useful in the present invention include vinyl alkyl sulfonic acids, and vinyl aromatic sulfonic acids. Examples of useful sulfonic acid compounds include vinyl sulfonic acid, vinyl naphthalene sulfonic acid, vinyl anthracene sulfonic acid, vinyl toluene sulfonic acid, methallylsulfonic acid (2-methyl-2-propene-1-sulfonic acid) and acrylamidohydrocarbyl sulfonic acid.

A particularly useful acrylamidohydrocarbyl sulfonic acid is 2-acrylamido-2-methylpropane sulfonic acid. This compound is available from The Lubrizol Corporation, Wickliffe, OH, USA under the trademark AMPS® Monomer. Other useful sulfo compounds include: 2-acrylamidoethane sulfonic acid, 2-acrylamidopropane sulfonic acid, 3-methylacrylamidopropane sulfonic acid, 1,1-bis(acrylamido)-2-methylpropane-2-sulfonic acid, and the like.

The sulfo compound may react with the hydroxyl-containing imide, amide or mixtures thereof as a sulfo acid as well as an ester, ammonium salt or metal salt of the sulfo acid. The ester may be formed by reacting one of the above sulfo acids with 1) a trialkylphosphate; 2) sulfur trioxide and an alcohol; 3) dialkylsulfate in dimethylformamide; 4) silver oxide and alkyl halide; and 5) alkylene oxide. The reactions described above are known to those in the art.

The preparation of esters of amido alkane sulfonic acid are described in U.S. Pat. No. 3,937,721; U.S. Pat. No. 3,956,354; U.S. Pat. No. 3,960,918; and German Patent 2,420,738.

Preferred esters are those having from 1 to about 40, preferably from 1 to about 20, more preferably from 1 to about 10, more preferably from 1 to about 6 carbon atoms in the ester group. Methyl esters are preferred.

When the sulfo compound is an ammonium salt, the ammonia salt may be prepared from ammonia, a monoamine or a polyamine.

The monoamines generally contain from 1 to about 24 carbon atoms, with 1 to about 12 carbon atoms being more preferred, with 1 to about 6 being more preferred. Examples of monoamines useful in the present invention include methylamine, ethylamine, propylamine, butylamine, octylamine, and dodecylamine. Examples of secondary amines include dimethylamine, diethylamine, dipropylamine, dibutylamine, methylbutylamine, ethylhexylamine, etc. Tertiary amine include trimethylamine, tributylamine, methyldiethylamine, ethyldibutylamine, etc.

In another embodiment the amines are any of the hydroxyamines described above.

The polyamines may be aliphatic, cycloaliphatic, heterocyclic or aromatic. Examples of the polyamines include alkylene polyamines and heterocyclic polyamines.

Alkylene polyamines are represented by the formula

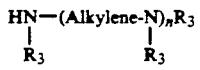

wherein n has an average value between about 1 and about 10, preferably about 2 to about 7 and the "Alkylene" group has from 1 to about 10 carbon atoms, preferably about 2 to about 6. As noted above, $R_3$ is preferably an aliphatic or hydroxy-substituted aliphatic group of up to about 30 carbon atoms.

Such alkylene polyamines include methylene polyamines, ethylene polyamines, butylene polyamines, propylene polyamines, pentylene polyamines, etc. The higher homologs and related heterocyclic amines such as piperazines and N-amino alkyl-substituted piperazines are also included. Specific examples of such polyamines are ethylene diamine, triethylene tetramine, tris-(2-aminoethyl)amine, propylene diamine, trimethylene diamine, tripropylene tetramine, tetraethylene pentamine, hexaethylene heptamine, pentaethylenehexamine, etc.

Higher homologs obtained by condensing two or more of the above-noted alkylene amines are similarly useful as are mixtures of two or more of the aforedescribed polyamines.

Ethylene polyamines, such as some of those mentioned above, are useful. Such polyamines are described in detail under the heading Ethylene Amines in Kirk Othmer's "Encyclopedia of Chemical Technology", 2d Edition, Vol. 7, pages 22–37, Interscience Publishers, NY (1965). Such polyamines are most conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as piperazines. Ethylene polyamine mixtures are useful.

The amine may also be a heterocyclic polyamine. Among the heterocyclic polyamines are aziridines, azetidines, azolidines, tetra- and dihydropyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkylsubstituted piperidines, piperazine, aminoalkyl-substituted piperazines, morpholine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine.

The ammonium salts of the sulfo compound may be prepared from ammonia or an amine. These salts are usually prepared at a temperature from ambient temperature to about 110° C., with about 30° C. to about 80° C. being preferred.

When the sulfo compound is a metal salt, the metal salt may be prepared by the reaction of the acid with an alkali, an alkaline earth or transition metal compound. The metal compounds are usually in the form of metal oxides, hydroxides, carbonates, sulfates, etc. Examples of metal compounds include sodium hydroxide or oxide, potassium hydroxide or oxide, calcium hydroxide or carbonate, zinc oxide or hydroxide, manganese oxide or hydroxide, magnesium oxide or hydroxide etc. The metal of the metal compound includes preferably sodium, potassium, calcium, magnesium, zinc or aluminum, more preferably sodium or potassium. The reaction usually occurs at a temperature of from about ambient temperature to about 150° C., with about 30° C. to about 125° C. being preferred. The acid is reacted with the metal compound in roughly stoichiometric amounts. A slight excess of metal-containing compound may be used.

The above sulfo compounds are reacted with a hydroxyl-containing imide, amide or mixtures thereof in the presence of a redox initiator. A useful redox initiator is one having an adequately low oxidation potential so that it can act with mild reducing agents such as hydroxyl groups to form a free radical. Preferably, the redox initiator is a cerium redox initiator, more preferably cerium ammonium nitrate or cerium ammonium sulfate, more preferably cerium ammonium nitrate. For purposes of the present invention, the redox initiator is used in the presence of a mineral acid. Preferably, the mineral acid is nitric acid.

The reaction between the hydroxyl-containing imide, amide or mixtures thereof and the sulfo compound may be generally described as graft polymerization. The initiating species is the hydroxyl-containing imide, amide or mixtures thereof, i.e., the hydroxyl-containing imide, amide or mixtures thereof is the place where a free radical is formed which causes polymerization. The graft polymerization occurs at a temperature of ambient temperature to about 75° C., more preferably from about 25° C. to about 50° C., more preferably from about 25° C. to about 45° C. The hydroxyl-containing amide, imide or mixture thereof is reacted with its sulfo compound at a molar ratio of about (1:1–20), more preferably about (1:1–10), more preferably about (1:3–7), more preferably about (1:5).

The following are examples of compositions of the present invention. Unless otherwise indicated, the temperature is degrees Celsius and parts are parts by weight.

EXAMPLE 3

A reaction vessel equipped with mechanical stirrer, a nitrogen inlet tube, and an addition funnel is charged with 40.4 parts (0.13 mole) of the product of Example 1, 247 parts (0.63 mole) of a 58% by weight solution of the sodium salt of 2-acrylamido-2-methyl-propane sulfonic acid in water, 200 parts of distilled water, and 4 parts of sodium lauryl sulfate. The mixture is purged with a subsurface sparge at a rate of one standard cubic foot per hour (SCFH) of nitrogen for one hour at a temperature of 22° C. Then, ten milliliters of a 0.1 molar solution of cerium ammonium nitrate in 1 molar nitric acid is added over 3 hours to the reaction mixture. The reaction mixture is stirred at room temperature for 12 hours. Another ten milliliters of the above cerium ammonium nitrate solution is added over 12 hours and the reaction mixture is stirred overnight. The reaction mixture is placed in a vacuum oven for 24 hours at 70° C. and 30 millimeters of mercury to remove water. The residue is ground with a mortar and pestle, and the ground residue is returned to the vacuum oven for 24 hours. The residue has 5.3% nitrogen (theoretical 5.68%) and 8.87% sulfur (theoretical 10.83%), and has an inherent viscosity of 1.6 dL/g (measured by 0.5 grams residue in 100 milliliters of 0.5 molar sodium chloride solution at 30° C.).

EXAMPLE 4

A vessel, equipped as described in Example 3, is charged with 40.4 parts (0.13 mole) of the product of Example 1, 130 parts (0.63 mole) of 2-acrylamido-2-methyl-propane sulfonic acid, 400 parts of distilled water and 4 parts of sodium lauryl sulfate. The mixture is purged with nitrogen at 0.5 SCFH at room temperature for 45 minutes. Then cerium ammonium nitrate (10 milliliters of the solution described in Example 3) is added over 14 hours. The reaction is stirred at room temperature for 45 hours. Another 10 milliliters of the cerium ammonium nitrate solution is added over 10 hours and stirring is continued for 10 hours. The water is removed as described in Example 3. The residue has 6.01% nitrogen (theoretical 6.15%), 11.59% sulfur (theoretical 11.72%) and an inherent viscosity of 0.93 dL/g.

EXAMPLE 5

A vessel equipped as described in Example 3, is charged with 247 parts (0.63 mole) of the sodium salt of 2-acrylamido-2-methylpropane sulfonic acid solution of Example 3, and 210 parts of distilled water. A solution of 1.35 parts (0.007 mole) of 2-acrylamido-2-methylpropane sulfonic acid and 10 grams of water is added to adjust the pH of the mixture to 4.0. Sodium lauryl sulfate (4 parts) and the product of Example 1 (40.4 parts, 0.13 mole) is added to the reaction vessel. The mixture is purged with nitrogen (0.5 SCFH for one-half hour at room temperature). Cerium ammonium nitrate (15 parts of the solution described in Example 3) is added dropwise over 30 hours. The reaction is stirred for an additional 12 hours. The water is removed as described in Example 3. The residue has 5.6% nitrogen (theoretical 5.7%), 10.8% sulfur (theoretical 10.9%), and an inherent viscosity of 1.3 dL/g.

EXAMPLE 6

A vessel equipped as described in Example 3, is charged with 395 parts (1 mole) of the sodium salt of 2-acrylamido-2-methylpropane sulfonic acid solution of Example 3 and 295 parts of distilled water. A solution of 0.3 parts of 2-acrylamido-2-methylpropane sulfonic acid in 5 parts of distilled water is added to adjust the pH of the mixture to 4.0. Sodium lauryl sulfate (6 parts) and the product of Example 2 (124 parts, 0.2 mole) are added to the vessel. The mixture is purged with nitrogen (0.5 SCFH at room temperature for 1.75 hours). Cerium ammonium nitrate (21.5 milliliters of the solution described in Example 3) is added over 65 hours. The reaction is stirred for an additional 12 hours. The water is removed as described in Example 3. The residue has 4.4% nitrogen (theoretical 4.7%) and 9.8% sulfur (theoretical 9.1%), and an inherent viscosity of 1.7 dL/g.

The polymer fabrics which are treated with wetting agents may be any polymer fabric, preferably a woven or nonwoven fabric, more preferably a nonwoven fabric. The polymer fabric may be prepared by any method known to those skilled in the art. When the fabric is nonwoven, it may be a spunbonded or melt-blown polymer fabric, preferably a spunbonded fabric. Spinbonding and melt-blowing processes are known to those in the art.

The polymer fabric may be prepared from any thermoplastic polymer. The thermoplastic polymer can be a polyester, polyamide, polyurethane, polyacrylic, polyolefin, combinations thereof, and the like. The preferred material is polyolefin.

The polyolefins are polymers which are essentially hydrocarbon in nature. They are generally prepared from unsaturated hydrocarbon monomers. However, the polyolefin may include other monomers provided the polyolefin retains its hydrocarbon nature. Examples of other monomers include vinyl chloride, vinyl acetate, acrylic acid or esters, methacrylic acid or esters, acrylamide and acrylonitrile. Preferably, the polyolefins are hydrocarbon polymers. The polyolefins include homopolymers, copolymers and polymer blends.

Copolymers can be random or block copolymers of two or more olefins. Polymer blends can utilize two or more polyolefins or one or more polyolefins and one or more nonpolyolefin polymers. As a practical matter, homopolymers and copolymers and polymer blends involving only polyolefins are preferred, with homopolymers being most preferred.

Examples of polyolefins include polyethylene, polystyrene, polypropylene, poly(1-butene), poly(2-butene), poly(1-pentene), poly(2-pentene), poly(3-methyl-1-pentene), poly(4-methyl-1-pentene), poly-1,3-butadiene and polyisoprene, more preferably polyethylene an polypropylene.

The wetting agents of the present invention are usually applied to the fabric as a 0.25 to about 2%, more preferably 0.5 to about 1%, more preferably 0.5 to about 0.75% by weight organic or aqueous mixture. The mixture may be a solution or dispersion. The organic mixture may be prepared by using volatile organic solvents. Useful organic solvents include alcohols, such as alcohols having from 1 to about 6 carbon atoms, including butanol and hexanol; or ketones, such as acetone or methylethylketone. Preferably the wetting agents are applied as an aqueous solution or dispersion. The wetting agents may be applied either by spraying the fabric or dipping the fabric into the mixture. After application of the wetting agents, the treated fabric is dried by any ordinary drying procedure such as drying at 120° C. for approximately 3 to 5 minutes.

A cowetting agent may be used to reduce wetting time of the above aqueous mixture. The cowetting agent is preferably a surfactant, more preferably a nonionic surfactant, more preferably a nonionic surfactant. Useful surfactants include the above described alkyl terminated polyoxyalkylenes, and alkoxylated phenols. Preferably, the surfactant is an alkyl terminated polyoxyalkylene.

The wetting time of the wetting agent mixture may also be reduced by heating the mixture. Usually the wetting agents are applied at room temperature. However, a 10°-15° C. increase in temperature significantly reduces wetting time.

Preferably, after drying the treated polymer fabrics have from about 0.1 to about 3%, more preferably about 0.1 to about 1%, more preferably about 0.5 to about 0.8% pickup based on the weight of the fabric. Percent pickup is the percentage by weight of wetting agent on a polymer fabric.

The following Table contains examples of polypropylene fabrics treated with the aqueous solutions or dispersions of wetting agent(s). The polymer fabric may be any polypropylene fabric available commercially. The aqueous solution or dispersion is applied in the amount shown in the Table. The polypropylene fabric is dipped into the aqueous solution or dispersion and then dried for 3-5 minutes at 125° C.

TABLE

| Examples | Wetting Agent | Amount Wetting Agent In Water |
|---|---|---|
| A | Example 3 | 1% |
| B | Example 4 | 0.75% |
| C | Example 5 | 0.5% |
| D | Example 6 | 0.75% |

The treated polymer fabrics have improved hydrophilic character. The treated fabrics show an improvement in the wicking/wetting ability. The polymer fabrics of the present invention may be formed into diapers, feminine products, surgical gowns, breathable clothing liners and the like by procedures known to those in the art.

The properties of the treated fabrics or products made with the fabrics may be measured by ASTM Method E 96-80, Standard Test Methods for Water Vapor Transmission of Materials, and INDA Standard Test 80 7-70 (82), INDA Standard Test for Saline Repellency of Nonwovens, often referred to as the Mason Jar Test. The later test uses a 0.9% by weight saline solution.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. An article, comprising:

at least one polymer fabric treated with at least one wetting agent which is prepared by reacting, in the presence of a redox initiator and a mineral acid, (a) at least one hydroxyl-containing imide, amide or mixture thereof of at least one hydrocarbyl substituted carboxylic acid or anhydride having a hydrocarbyl group containing from about 8 to about 150 carbon atoms and at least one hydroxy amine with;

(b) at least one sulfo compound represented by the following formula:

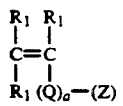

wherein each $R_1$ is independently hydrogen or a hydrocarbyl group;

a is 0 or 1;

Q is a hydrocarbylene group or —C(X)N($R_2$)Q'—;

$R_2$ is hydrogen or a hydrocarbyl group;

X is sulfur or oxygen;

Q' is a hydrocarbylene group; and

Z is —S(O)OH, or —S(O)$_2$OH or an ester, a metal salt or an ammonium salt of the sulfo compound.

2. The article of claim 1, wherein $R_1$ and $R_2$ are each independently hydrogen or an alkyl group having from 1 to about 12 carbon atoms; a is 1; and Q is an arylene or alkarylene group having from 6 to about 18 carbon atoms, an alkylene group having from 1 to about 18 carbon atoms, or —C(O)N($R_2$)Q'—.

3. The article of claim 1, wherein a is 1, Q is —C(O)N($R_2$)Q'—, and Q' is an alkylene group having from 1 to about 16 carbon atoms.

4. The article of claim 1, wherein a is 1 and Q is an arylene or alkarylene group having from 6 to about 12 carbon atoms.

5. The article of claim 1, wherein a is 1, Q is —C(O)N($R_2$)Q'— and Q' is an alkylene group having from 1 to about 8 carbon atoms.

6. The article of claim 1, wherein a is 1, Q is —C(O)N($R_2$)Q'— and Q' is dimethylethylene.

7. The article of claim 1, wherein the hydrocarbyl group of the hydrocarbyl substituted carboxylic acid or anhydride is an alkyl or alkenyl group having from about 8 to about 30 carbon atoms, a polyalkene group having a number average molecular weight from about 400 to about 2000, or mixtures thereof.

8. The article of claim 1, wherein the hydrocarbyl group of the hydrocarbyl substituted carboxylic acid or anhydride is an alkyl or alkenyl group having from about 8 to about 24 carbon atoms.

9. The article of claim 1, wherein the hydrocarbyl group of the hydrocarbyl substituted carboxylic acid or anhydride is a polyalkene group having a number average molecular weight from about 900 to about 1200.

10. The article of claim 1, wherein the carboxylic acid or anhydride of (a) is an alkenyl carboxylic anhydride or acid having from about 10 to about 18 carbon atoms in the alkenyl group.

11. The article of claim 1, wherein the hydroxy amine of (a) is tris(hydroxymethyl)aminomethane, ethanol amine, diethanol amine or 1-amino-2-propanol.

12. The article of claim 1, wherein the at least one hydroxy amine is 1-amino-2-propanol.

13. The article of claim 1, wherein the redox initiator is selected from the group consisting of cerium ammonium nitrate, and cerium ammonium sulfate and the mineral acid is nitric acid.

14. The article of claim 1, wherein the reacting is graft polymerizing.

15. The article of claim 1, wherein (a) is reacting with (b) at a molar ratio of about (1:1-20).

16. The article of claim 14, wherein the polymer fabric is nonwoven.

17. The article of claim 1, wherein the polymer of the fabric is a polyethylene or polypropylene fabric.

18. An article, comprising:

at least one polymer fabric treated with at least one wetting agent which is prepared, in the presence of a redox initiator and a mineral acid, by reacting (a) at least one imide, amide or mixture thereof of at least one carboxylic acid or anhydride selected from an alkyl or alkenyl carboxylic acid or anhydride having from about 8 to about 30 carbon atoms in the alkyl or alkenyl group, a polyalkene substituted carboxylic acid or anhydride having a polyalkene group with a number average molecular weight from about 400 to about 2000, and mixtures thereof and at least one hydroxy amine with;

(b) at least one vinyl or allyl sulfonic acid or salt thereof.

19. The article of claim 18, wherein the sulfonic acid or salt is an acrylamido hydrocarbyl sulfonic acid or salt.

20. The article of claim 18, wherein the sulfonic acid or salt is 2-acrylamido-2-methylpropane sulfonic acid or salt.

21. The article of claim 18, wherein the carboxylic acid or anhydride is an alkyl or alkenyl carboxylic acid or anhydride having from about 8 to about 24 carbon atoms in the alkyl or alkenyl group.

22. The article of claim 18, wherein the carboxylic acid or anhydride is a polyalkene substituted carboxylic acid or anhydride having a polyalkene group with a number average molecular weight from about 900 to about 1200.

23. The article of claim 21, wherein the alkenyl carboxylic acid or anhydride of (a) is an alkenyl succinic acid or anhydride and has from about 10 to about 18 carbon atoms in the alkenyl group.

24. The article of claim 18, wherein the hydroxy amine of (a) is tris(hydroxymethyl)aminomethane, ethanol amine, diethanol amine or 1-amino-2-propanol.

25. The article of claim 18, wherein the redox initiator is cerium ammonium nitrate, and the mineral acid is nitric acid.

26. The article of claim 18, wherein the reacting is graft polymerizing and the molar ratio of (a):(b) is about (1:1-20).

27. The article of claim 18, wherein the polymer fabric is nonwoven.

28. The article of claim 18, wherein the polymer fabric is a polyethylene or polypropylene fabric.

29. A process for improving wettability of a polymer fabric, comprising the step of treating at least one polymer fabric with a composition prepared by reacting, in the presence of a redox initiator and a mineral acid, (a) at least one hydroxyl-containing imide, amide or mixture thereof of at least one hydrocarbyl substituted carboxylic acid or anhydride having a hydrocarbyl group containing from about 8 to about 150 carbon atoms and at least one hydroxy amine; with (b) at least one sulfo compound represented by the following formula:

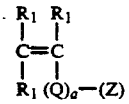

wherein each $R_1$ is independently hydrogen or a hydrocarbyl group a is zero or one;

Q is a hydrocarbylene group or —C(X)N($R_2$)O'—;

$R_2$ is hydrogen or a hydrocarbyl group,

X is sulfur or oxygen;

Q' is a hydrocarbylene group; and z is —S(O)OH, or —S(O)$_2$OH or an ester, metal salt or ammonium salt of the sulfo compound.

30. A diaper containing the article of claim 1.

31. A diaper containing the article of claim 18.

* * * * *